US006752509B1

(12) United States Patent
Lin et al.

(10) Patent No.: US 6,752,509 B1
(45) Date of Patent: Jun. 22, 2004

(54) ILLUMINATING UMBRELLA GRIP DETACHABLY MOUNTED WITH CASSETTE LED ILLUMINATING UNIT

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 10/307,961

(22) Filed: Dec. 3, 2002

(51) Int. Cl.[7] ..... A63B 15/02

(52) U.S. Cl. ..... 362/102; 362/253; 362/800

(58) Field of Search ..... 362/102, 109, 362/800

(56) References Cited

U.S. PATENT DOCUMENTS 3,281,586 A * 10/1966 Gonzalez ..... 362/102
4,860,179 A * 8/1989 Mui et al. ..... 362/102
5,848,831 A * 12/1998 Tatsumi ..... 362/102

* cited by examiner

*Primary Examiner*—Sandra O'Shea
*Assistant Examiner*—Guiyoung Lee
(74) *Attorney, Agent, or Firm*—Troxell Law Office PLLC

(57) ABSTRACT

An illuminating umbrella grip includes a cassette LED illuminating unit detachably mounted in a holder formed on the umbrella grip, with the LED illuminating unit operatively depressed for a constant or flashing illumination; and upon withdrawal of the LED illuminating unit from the umbrella grip, it may be operated to produce illuminating warning signal for safety purpose, or it may be replaced with a fresh LED unit as fully powered.

5 Claims, 4 Drawing Sheets

Fig. 3
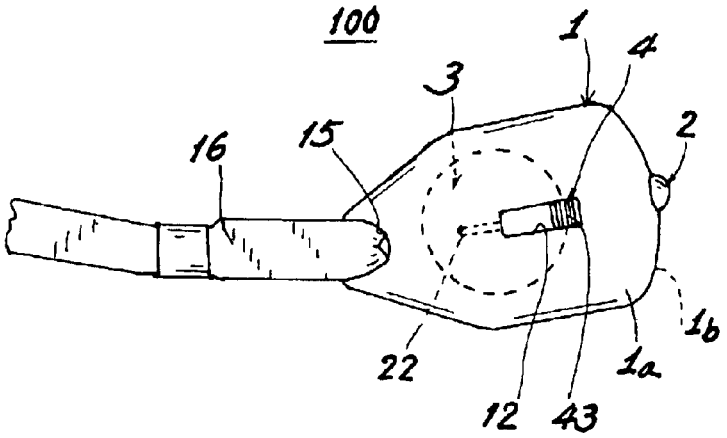
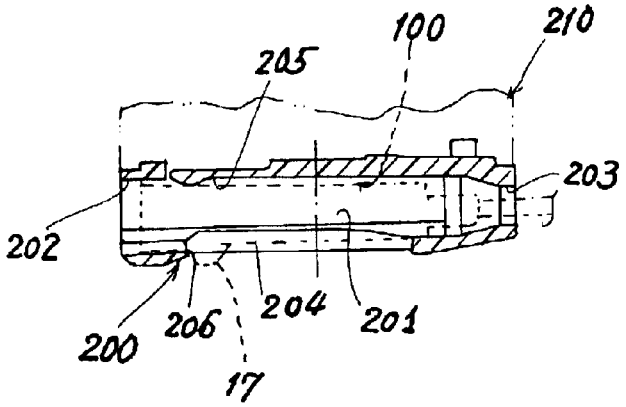
Fig. 4

ILLUMINATING UMBRELLA GRIP DETACHABLY MOUNTED WITH CASSETTE LED ILLUMINATING UNIT

BACKGROUND OF THE INVENTION

U.S. Pat. No. 6,126,291 granted to the same inventors of this application disclosed an umbrella having detachable illuminative grip (100), which however has the following drawbacks:

1. When the illuminative grip (100) is removed from the inner grip portion (202) of the shaft (201), the inner grip portion (202) will become a "slim bar" and will be inconveniently held or grasped by the umbrella user.
2. The lamp means includes a bulb (41) mounted in the grip (100), with the bulb consuming much electric energy for illumination, requiring larger volume and also being vulnerable and easily damaged.
3. No flashing mechanism is provided in the lamp means (4) to thereby reduce its safety warning effect.

The present inventor has found the drawbacks of the conventional illuminating umbrella, and invented the present umbrella grip having cassette LED illuminating unit detachably mounted therein.

SUMMARY OF THE INVENTION

The object of the present invention is to provide an illuminating umbrella grip including a cassette LED illuminating unit detachably mounted in a holder formed on the umbrella grip, with the LED illuminating unit operatively depressed for a constant or flashing illumination; and upon withdrawal of the LED illuminating unit from the umbrella grip, it may be operated to produce illuminating warning signal for safety purpose, or it may be replaced with a fresh LED unit as fully powered.

BRIEF DESCRIPTION OF THE DRAWINGS

FIG. 3 is a bottom view of the cassette LED illuminating unit.

FIG. 4 is a sectional drawing of the holder adapted for engaging the LED illuminating unit.

FIG. 6 shows the LED illuminating unit of the present invention when turned on.

DETAILED DESCRIPTION

Figures 1, 2:
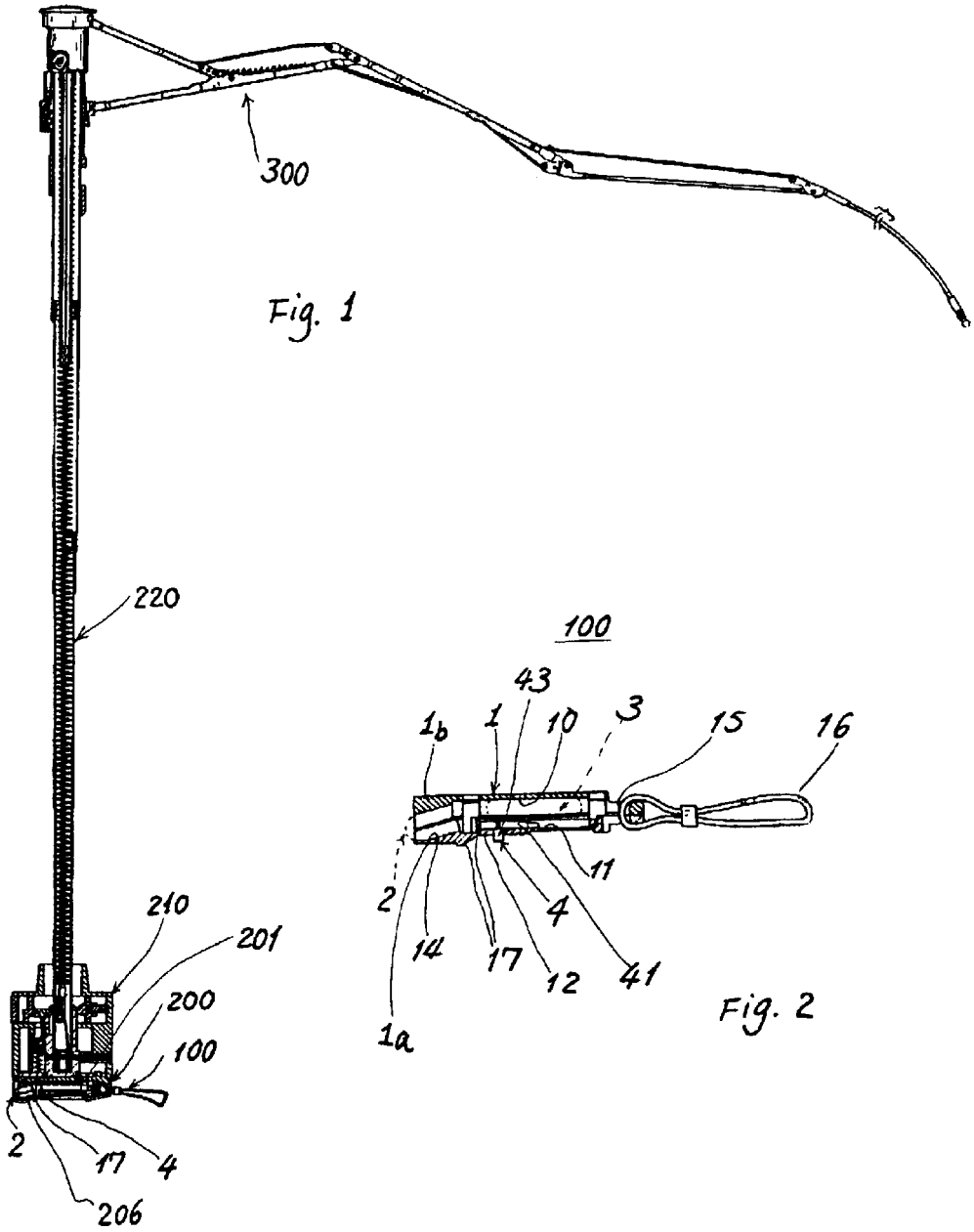
FIG. 1 is an illustration showing an opened umbrella of the present invention, which can be automatically opened or closed.
FIG. 2 is a sectional drawing of the cassette LED illuminating unit of the present invention.

As shown in FIGS. 1~6, the present invention discloses an illuminating umbrella grip 210 comprising a cassette LED (Light-Emitting Diode) illuminating unit 100 detachably mounted in a holder 200 formed on the umbrella grip 210, especially formed on a lower portion of the umbrella grip 210.

The umbrella of the present invention includes a central shaft 220 consisting of a plurality of tubes telescopically engageable with one another and a rib assembly 300 for securing an umbrella cloth on the rib assembly 300 pivotally secured to the shaft 220.

Figure 8:
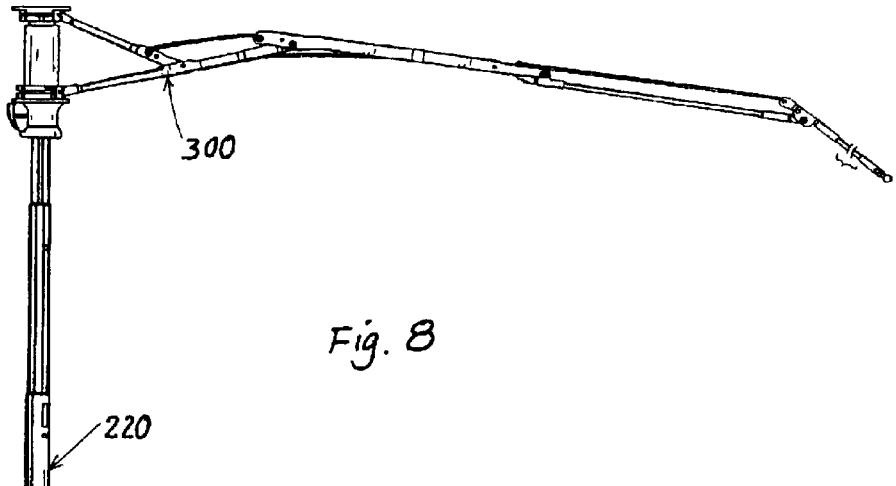
FIG. 8 shows an opened umbrella of the present invention as held in a manually operated umbrella.

The umbrella as shown in FIG. 1 is an automatically opened or closed umbrella with multiple folds, but it may also be modified to be a manually operated umbrella as shown in FIG. 8 or a single-fold umbrella, not limited in the present invention.

The holder 200 may be formed on or fixed to the grip 210 by screws or by adhesive bonding, integral forming, or by any other joining methods, not limited in the present invention.

The holder 200 is preferably formed on or secured to a bottom portion of the umbrella grip 210 to allow the LED illuminating unit 100 to be easily switched on or off through a bottom opening of the grip.

The cassette LED illuminating unit 100 includes: a housing 1, a LED (light emitting diode) 2 mounted in the housing 1 for projecting light forwardly through a front opening 14 formed in the housing 1, at least a battery (including button cells) 3 stored in the housing 1 and electrically connected to the LED 2 through a switch 4 slidably or movably formed on or in the housing 1 for switching on the LED 2 for illumination or for turning off the LED 2.

The housing 1 includes a bottom cover 1*a* combined with an upper cover 1*b* by screws or by other joining methods to define a battery chamber 10 in between the upper and bottom covers 1*b*, 1*a* for storing the battery 3 (e.g. one or two button cells) in the battery chamber 10.

The housing 1 further includes a ring portion 15 formed on a rear portion of the housing 1 to be fastened by a string 16 for a convenient pulling of the housing 1 to be snugly engaged with a cavity 201 formed in the holder 200 as shown in FIGS. 1 and 4 for smoothly mounting the LED illuminating unit 100 in the holder 200 of the umbrella grip 210. The string 16 is also provided for carrying the umbrella of the present invention.

The housing 1 is preferably made of transparent materials, and is preferably formed as thin disk shape to be slidably inserted into or withdrawn from the holder 200 formed or fixed in the umbrella grip 210.

The LED 2 includes a first pin 21 adjacent to the upper cover 1*b* of the housing and contacting a first electrode or the positive electrode 31 of the battery 3, and a second pin 22 adjacent to the bottom cover 1*a* of the housing 1 and electrically connected with a second electrode or the negative electrode 32 of the battery 3 through the switch 4 slidably or movably formed on the bottom cover 1*a*.

The switch 4 includes: a sliding plate 41 slidably held in a shallow chamber 11 formed in the bottom cover 1*a*; a collar 42 protruding inwardly from the sliding plate 41 and slidably engaging with the second pin 22 of the LED 2, with the collar 42 made of electrically insulative material and being normally resiliently biased by the second pin 22 of LED to be separated from the second electrode 32 of the battery to normally switch off the power supply from the battery 3 to the LED 2 through the second pin 22 (FIG. 5); and a push button 43 protruding outwardly or downwardly from the sliding plate 41 to be slidably guided by a slot 12 longitudinally notched through the bottom cover 1*a* allowing a sliding or depression movement of the push button 43 of the switch 4; whereby upon contacting of the second pin 22 of LED 2, as driven by the push button 43 moving in the bottom cover 1*a*, with the second electrode 32 of the battery 3, the LED 2 will be powered by the battery 3 for its illumination.

Figure 5:
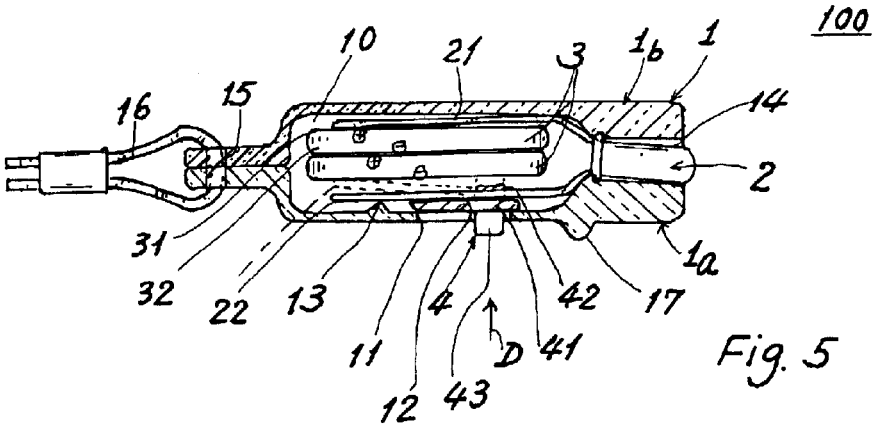
FIG. 5 shows the LED illuminating unit of the present invention when normally turned off.

The switch 4 has the collar 42 resiliently biased downwardly or outwardly by the second pin 22 of LED 2 to be normally separated from the second electrode 32 of the battery 3 to normally switch off the power supply from the battery 3 to the LED 2; whereby upon an inward or upward depression (D) of the push button 43, the second pin 22 of LED 2 will be urged inwardly or upwardly to contact the second electrode 32 of the battery 3 to close a power supply circuit between the battery 3 and the LED 2 to illuminate the LED 2 as dotted line shown in FIG. 5; while releasing the depression of the push button 43, the second pin 22 will resiliently restore the collar 42 and the switch 4 downwardly to switch off the LED 2; whereby upon alternative depression or releasing of the push button, the LED will be switched on or off alternatively for a manual flashing operation.

Figure 6:
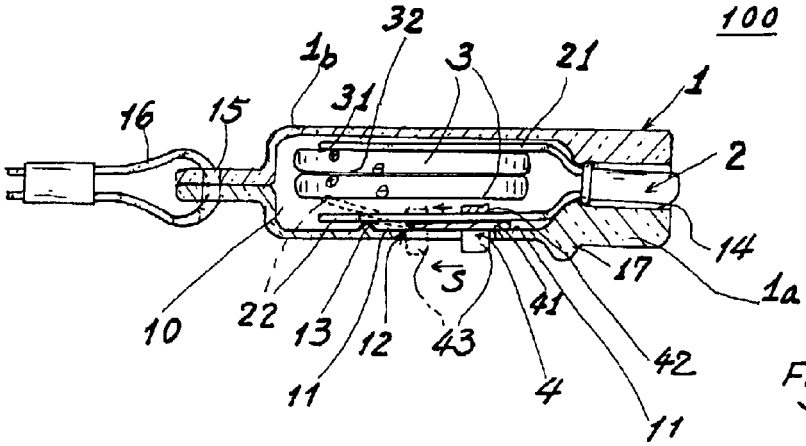

The switch 4 has the sliding plate 42 slidably held in the shallow chamber 11 recessed in the bottom cover 1*a* having at least a protuberance 13 protruding inwardly or upwardly towards the battery 3; whereby upon a rearward sliding movement of the switch 4 by pushing the button 43 rearwardly, the sliding plate 42 will be simultaneously thrusted rearwardly to be gradually biased by the protuberance 13 as shown in FIG. 6 to inwardly or upwardly bend the second pin 22, as held on the collar 42 formed on the sliding plate 41, to be contacted with the second electrode 32 of the battery 3 to power and illuminate the LED 2.

As shown in FIG. 4, the holder 200 includes: a cavity 201 formed in a hollow portion in the holder 200 for embedding the cassette LED illuminating unit 100 in the cavity 201, a front hole 202 having a width generally equal to a width of the LED illuminating unit 100 for inserting the LED illuminating unit 100 therethrough, a rear hole 203 formed in a rear portion of the holder 200 for passing the string 16 of the housing 1 of the LED illuminating unit through the rear hole 203, a bottom hole 204 formed in a bottom portion of the holder 200 to reveal the push button 43 of the switch 4 of the LED illuminating unit 100 for an operation of the push button 43 through the bottom hole 204, a resilient hook member 205 resiliently formed on an upper portion of the holder 200 for resiliently urging the LED illuminating unit 100 downwardly to engage a protrusion 17 formed on a bottom portion of the LED illuminating unit 100 with a stopping portion 206 formed on a front portion of the holder 200 for stopping a forward releasing of the LED illuminating unit 100 from the holder 200 (FIG. 4 and FIG. 9); whereby upon inward or upward depression of the protrusion 17 to disengage from the stopping portion 206, the LED illuminating unit 100 will be removed from the holder.

Figure 7:
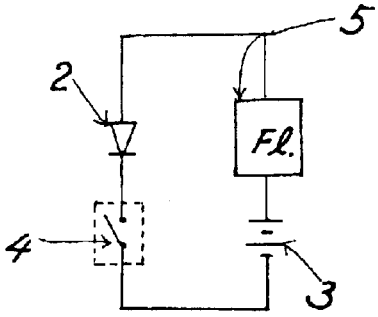
FIG. 7 shows the circuit diagram of the LED illuminating unit driven with a flasher in accordance with the present invention.

As shown in FIG. 7, a flasher (Fl.) 5 is connected in series in an illumination circuit including the LED 2, the switch 4 and the battery 3, whereby upon actuation of the switch 4 to start the flasher 5, the LED 2 will be blinked automatically as driven by the flasher 5.

Figure 9:
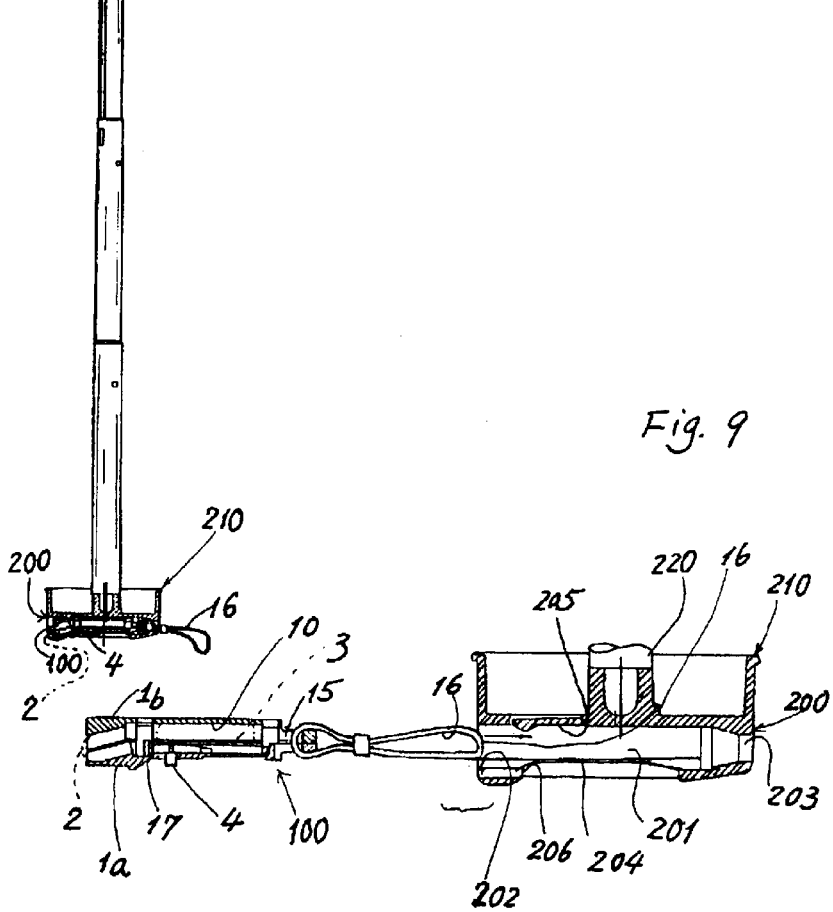
FIG. 9 is sectional drawing of the present invention having the parts enlarged from the umbrella of FIG. 8.

For embedding or inserting the LED illuminating unit 100 in the holder 200 integrally formed on the umbrella grip 210 as shown in FIGS. 8, 9, a manually-operated umbrella will be implemented with the illuminating device, i.e., the LED 2, for a safe illumination purpose.

The present invention is superior to a conventional illuminating umbrella with the following advantages:

1. The illuminating device is a LED with miniature volume, light weight, and convenient operation and maintenance.
2. The LED illuminating unit 100 can be conveniently detachably withdrawn from the holder 200 on the umbrella grip 210 for a convenient maintenance, e.g., for replacing a new unit 100 and for serving as a miniature portable device for a convenient lighting or optical safety warning or signaling purpose.
3. Since the LED unit 100 is a small unit and even after being removed from the grip 210, the umbrella grip 210 can still be ergonomically grasped.
4. Either manual or automatic flashing mechanism is provided for a flashing illumination for better warning effect.

The present invention may be modified without departing from the spirit and scope of this invention.

We claim:

1. An illuminating umbrella grip comprising:

a holder formed on an umbrella grip secured to a central shaft of an umbrella; and a cassette LED (light-emitting diode) illuminating unit detachably mounted in said holder on said umbrella grip; said cassette LED illuminating unit including: a housing, a LED (light-emitting-diode) mounted in the housing projecting light forwardly through an opening formed in the housing, at least a battery stored in the housing and electrically connected to the LED through a switch movably formed in the housing for switching on the LED for illuminating or for turning off the LED;

said housing including a ring portion formed on a rear portion of the housing fastened by a string for convenient pulling of the housing to be snugly engaged with a cavity formed in said holder for smoothly mounting the LED illuminating unit in the holder on the umbrella grip;

said housing made of transparent material, and formed as a thin disk slidably inserted into or withdrawn from the holder formed in the umbrella grip;

whereby upon actuation of said cassette LED illuminating unit on said umbrella grip, said light-emitting diode of said LED illuminating unit is lit for illumination; and upon withdrawal of said cassette LED illuminating unit from said umbrella grip, said cassette LED illuminating unit will serve as a portable miniature lighting or signaling device.

2. An illuminating umbrella grip according to claim 1, wherein said switch operatively switches the LED having a first pin of said LED contacting a first electrode of the battery, and said switch includes: a sliding plate slidably held in a shallow chamber formed in a bottom cover of said housing; a collar protruding inwardly from the sliding plate and slidably engaging with a second pin of the LED, with the collar made of electrically insulative material and normally holding the second pin of LED to be separated from a second electrode of the battery to normally switch off the power supply from the battery to the LED through the second pin; and a push button protruding outwardly or downwardly from the sliding plate to be slidably guided by a slot longitudinally notched through the bottom cover allowing a sliding or depression movement of the push button of the switch; whereby upon contacting of the second pin of LED, as driven by the push button moving in the bottom cover, with the second electrode of the battery, the LED will be powered by the battery for the illumination of the LED.

3. An illuminating umbrella grip according to claim 2, wherein said switch has the collar normally resiliently biased downwardly or outwardly bey the second pin of LED to be separated from the second electrode of the battery to normally switch off the power supply from the battery to the LED; whereby upon an inward or upward depression of the push button, the second pin of LED will be urged inwardly or upwardly to contact the second electrode of the battery to close a power supply circuit between the battery and the LED to illuminate the LED; while releasing the depression of the push button, the second pin will resiliently restore the collar an the switch downwardly to switch off the LED; and whereby upon alternative depression or releasing of the push button, the LED will be switched on or off alternatively for a manual flashing operation.

4. An illuminating umbrella grip according to claim 2, wherein said switch has the sliding plage slidably held in the bottom cover having at least a protuberance protruding inwardly or upwardly towards the battery; whereby upon a rearward sliding movement of the switch by pushing the button rearwardly, the sliding plate will be simultaneously thrusted rearwardly to be gradually biased by the protuberance to inwardly or upwardly bend the second pin, as held on the collar formed on the sliding plate, to be contacted with the second electrode of the battery to power and illuminate the LED.

5. An illuminating umbrella grip according to claim 1, wherein said holder includes: a cavity formed in a hollow portion in the holder for embedding the cassette LED illuminating unit in the cavity, a front hole having a width generally equal to a width of the LED illuminating unit for inserting the LED illuminating unit therethrough, a rear hole formed in a rear portion of the holder for passing said string of the holder of the LED illuminating unit through the rear hole, a bottom hole formed in a bottom portion of the holder to reveal a push button of said switch of the LED illuminating unit for operating the push button through the bottom hole, a resilient hook member resiliently formed in the holder for resiliently urging the LED illuminating unit downwardly to engage a protrusion formed on a bottom portion of the LED illuminating unit with a stopping portion formed on a front portion of the holder for stopping a forward releasing of the LED illuminating unit from the holder; whereby upon inward or upward depression of the protrusion to disengage from the stopping portion, the LED illuminating unit will be removed from the holder.

* * * * *